US010004969B1

(12) United States Patent
Bulanov

(10) Patent No.: US 10,004,969 B1
(45) Date of Patent: Jun. 26, 2018

(54) BOWLING TRAINING APPARATUS AND METHOD

(71) Applicant: Maxim Bulanov, Moscow (RU)

(72) Inventor: Maxim Bulanov, Moscow (RU)

( * ) Notice: Subject to any disclaimer, the term of this patent is extended or adjusted under 35 U.S.C. 154(b) by 0 days. days.

(21) Appl. No.: 15/676,877

(22) Filed: Aug. 14, 2017

(51) Int. Cl.

| | |
|---|---|
| ***A63B 69/00*** | (2006.01) |
| ***A63D 5/04*** | (2006.01) |
| ***A63B 71/06*** | (2006.01) |
| ***A63B 24/00*** | (2006.01) |

(52) U.S. Cl.
CPC ..... *A63B 69/0046* (2013.01); *A63B 24/0021* (2013.01); *A63B 71/0622* (2013.01); *A63D 5/04* (2013.01); *A63B 2220/12* (2013.01); *A63B 2220/30* (2013.01); *A63B 2220/72* (2013.01); *A63B 2220/75* (2013.01); *A63B 2225/093* (2013.01); *A63B 2225/20* (2013.01)

(58) Field of Classification Search
USPC ..... 473/54, 55, 58, 106
See application file for complete search history.

(56) References Cited

U.S. PATENT DOCUMENTS 3,252,705 A * 5/1966 Cornberg ..... A63D 5/04 273/371
5,683,302 A * 11/1997 Harrell ..... A63D 5/04 473/58
6,077,167 A * 6/2000 Ciniello ..... A63D 5/04 473/54
6,110,052 A * 8/2000 Sprager ..... A63D 5/04 340/323 B
6,270,421 B1 * 8/2001 Tsujita ..... A63D 5/04 473/54
8,088,017 B2 * 1/2012 Stremmel ..... A63D 5/04 434/249
2008/0032808 A1 * 2/2008 Ochi ..... A63D 5/00 473/106

* cited by examiner

*Primary Examiner* — Nini Legesse
(74) *Attorney, Agent, or Firm* — Gulf Coast Intellectual Property Group

(57) ABSTRACT

A bowling training apparatus and method of use that is operable to facilitate the identity of a bowling ball on a lane at a desired point. The bowling training apparatus specifically identifies a board number of a bowling lane that the bowling ball was located at a particular point and displays the board number to the user. The bowling training apparatus further includes a housing having a central processing unit disposed therein. A sensor assembly is secured to the housing wherein the sensor assembly is coupled to the housing utilizing a mount. The mount is configured to permit vertical adjustment of the sensor assembly. A ball position sensor is integrated into the sensor assembly. The housing further includes a display screen configured to display the board number location of a passing bowling ball. The bowling training apparatus further measures temperature, speed and relative humidity.

20 Claims, 5 Drawing Sheets

BOWLING TRAINING APPARATUS AND METHOD

PRIORITY UNDER 35 U.S.C SECTION 119(E) & 37 C.F.R. SECTION 1.78

This nonprovisional application claims priority based upon the following prior United States Provisional Patent Application entitled: Electronic device for real time registration of position and speed of a bowling ball on lane, Application No.: 62/377,392 filed Aug. 19, 2016, in the name of Maxim Bulanov, which is hereby incorporated by reference for all purposes.

FIELD OF THE INVENTION

The present invention relates generally to bowling, more specifically but not by way of limitation, a bowling training apparatus that is operable to provide instant feedback for parameters such as but not limited to the position of the bowling ball and speed at a desired point such as but not limited to the break point or target point.

BACKGROUND

Bowling is a global sport and has more participants globally than any other sport. The critical mass of participants has kept bowling popular for many decades. Participants demographics range from young children to senior citizens. Further, these participants vary in the amount that they engage in a game of bowling from a casual involvement wherein the some participants play only a few games a year and others become heavily involved in the sport and play either in leagues or attempt to play professionally.

Those participants who play the game of bowling frequently will often develop a practice regimen in order to improve their game. Bowling is a game of precision and there are many parameters that can affect the performance of a player. As is known in the art, bowling lanes are manufactured from wood or synthetic surface and have a specific oil pattern thereon so parameters such as the temperature and humidity within the bowling alley can affect performance. Another parameter that is important to bowlers is knowing where the bowling ball is located on the lane at a particular point. As is known in the art, the wood of each bowling lane is manufactured from wood boards that are approximately one inch in width. Good bowlers typically throw the bowling ball in an arcuate pattern wherein a typical path for a bowling ball will involve the bowling ball traversing towards a target point and subsequently curve proximate the breaking point. Depending upon the objective of the player's throw and oil pattern, the target point and break point can be in various locations longitudinally along the bowling lane. For training purposes it is very important for a player to know where the bowling ball is laterally on the bowling lane. The lateral identification of the bowling ball at the aforementioned points assist the bowler in understanding the exact position of the bowling ball and how to improve based on the results of a throw.

Accordingly, there is a need for a bowling training apparatus that provides instant feedback on parameters such as but not limited to ball position and speed to a bowler wherein the bowling training apparatus provides the lateral position of the bowling ball on a bowling lane by providing the board number location at a particular point.

SUMMARY OF THE INVENTION

It is the object of the present invention to provide a bowling training apparatus that is operable to provide the lateral location of a bowling ball on a bowling lane wherein the apparatus includes a housing that is configured to be superposed the lane capping intermediate adjacent bowling lanes.

Another object of the present invention is to provide a bowling training apparatus operable to display the board location of a bowling ball on a bowling lane at a particular point wherein the housing further includes a central processing unit operable to store, receive, transmit and manipulate data.

A further object of the present invention is to provide a bowling training apparatus that is operable to provide the lateral location of a bowling ball on a bowling lane wherein the housing includes an integrated display screen.

An additional object of the present invention is to provide a bowling training apparatus operable to display the board location of a bowling ball on a bowling lane wherein the bowling training apparatus includes a first sensor movably mounted to the exterior of the housing.

Yet a further object of the present invention is to provide a bowling training apparatus that is operable to provide the lateral location of a bowling ball on a bowling lane that further includes additional sensors operable to measure temperature and humidity.

A further object of the present invention is to provide a bowling training apparatus operable to display the board location of a bowling ball on a bowling lane that further includes a remote sensor electrically coupled to the housing wherein the remote sensor is configured to calculate the speed of the bowling ball.

Another object of the present invention is to provide a bowling training apparatus that is operable to provide the lateral location of a bowling ball on a bowling lane wherein the housing includes an interface screen and controls operable to facilitate the use and calibration of the bowling training apparatus.

Still an additional object of the present invention is to provide a bowling training apparatus operable to display the board location of a bowling ball on a bowling wherein the board location of the bowling ball is instantly provided to the bowler as the bowling ball passes a desired point such as but not limited to a break point or target point.

Yet an alternative object of the present invention is to provide a bowling training apparatus that is operable to provide the lateral location of a bowling ball on a bowling lane wherein the housing is movable along the lane capping intermediate adjacent bowling lanes so as to facilitate measurement at a desired point on the bowling lane.

Another object of the present invention is to provide a bowling training apparatus that further includes a laser pointer wherein the laser pointer is operable to emit a laser light and can be adjusted to emit onto a bowling lane so as to provide a target for a user.

An additional object of the present invention is to provide a bowling training apparatus wherein the housing is configured to be temporarily installed on lane capping intermediate bowling lanes and is further movable therealong so as to locate in numerous positions.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
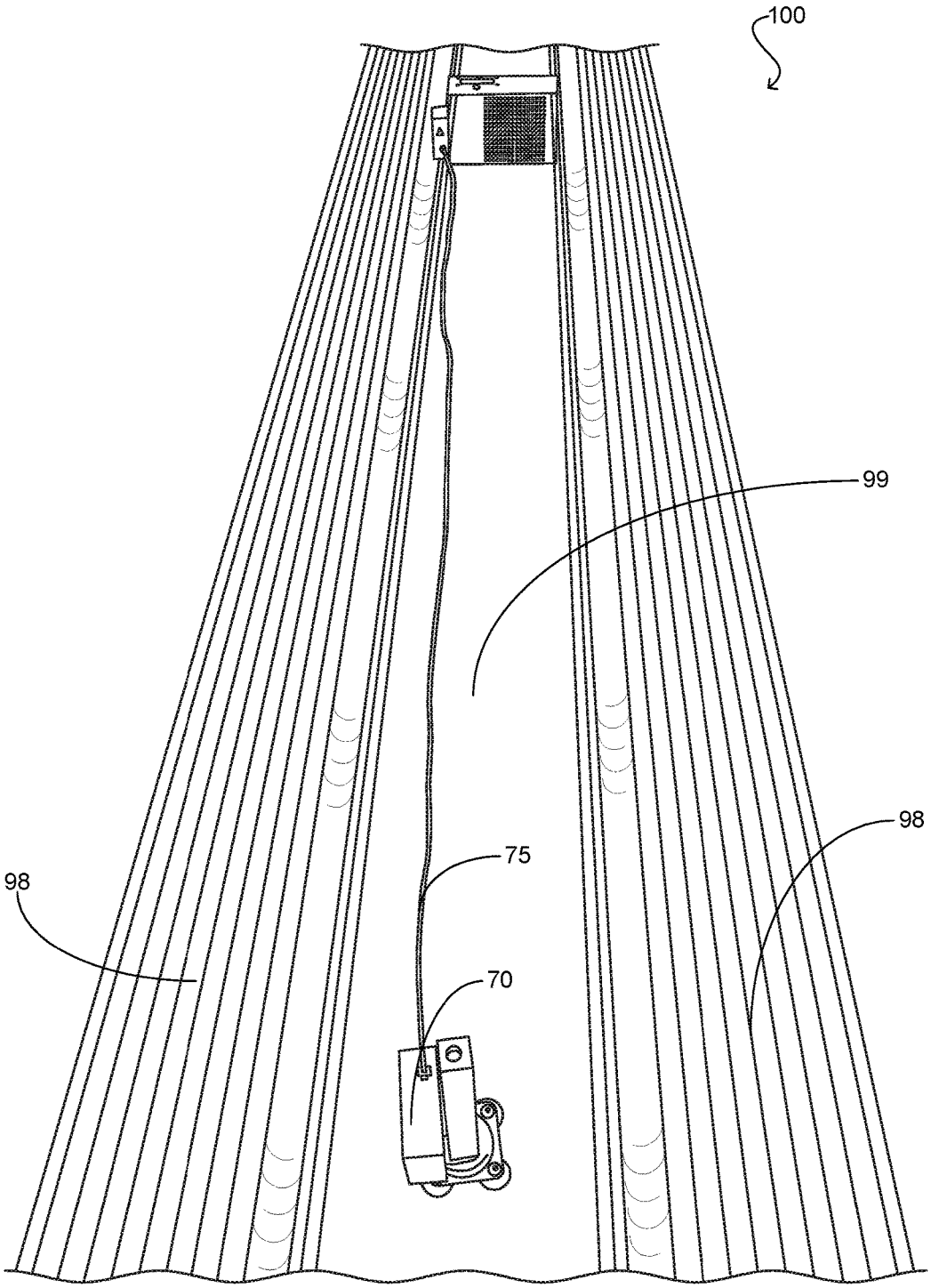
FIG. 1 is a top perspective view of the present invention on a bowling lane.

Referring now to the drawings submitted herewith, wherein various elements depicted therein are not necessarily drawn to scale and wherein through the views and figures like elements are referenced with identical reference numerals, there is illustrated a bowling training apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
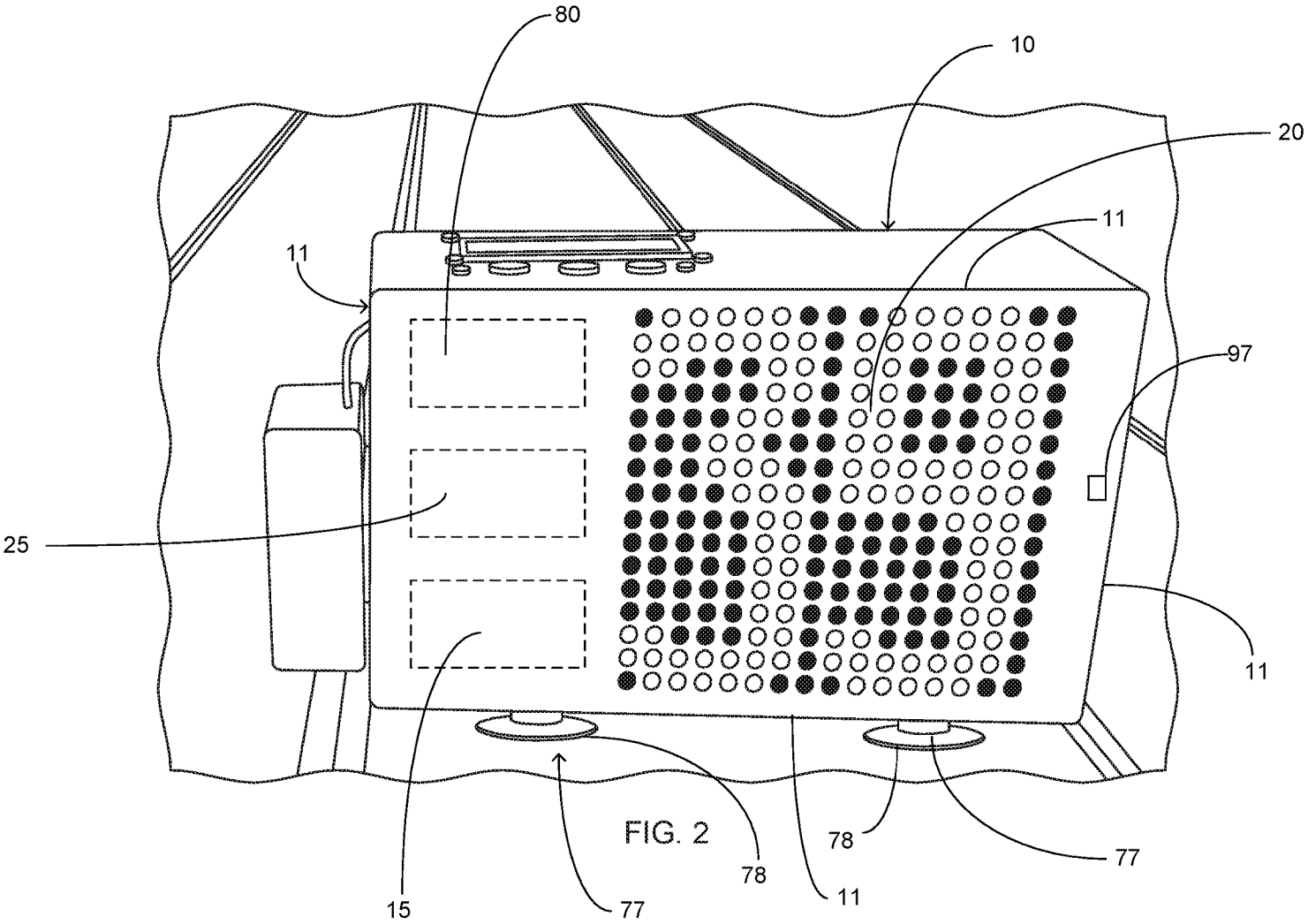
FIG. 2 is a front view of an embodiment of the present invention.
Figure 4:
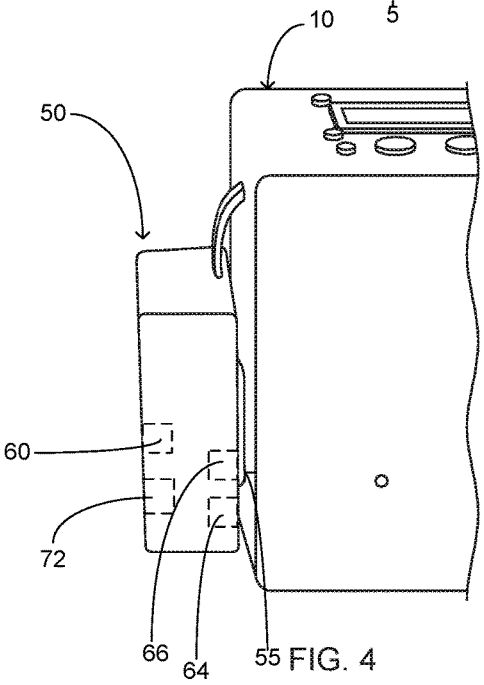
FIG. 4 detailed view of the sensor assembly of the present invention.

Referring in particular FIGS. 2 and 4, the bowling training apparatus 100 further includes a housing 10. The housing 10 includes a plurality of walls 11 forming an interior volume and is manufactured from a durable lightweight material such as but not limited to plastic. While the housing 10 is illustrated herein as being rectangular in shape, it is contemplated within the scope of the present invention that the housing 10 could be manufactured in alternate shapes. It is however, preferred within the scope of the present invention that the housing 10 is manufactured having a width that is equal to the exemplary lane capping 99 that is typically found intermediate the gutters of adjacent bowling lanes 98. As will be further discussed herein, the bowling training apparatus 100 is operable to provide the lateral location of a bowling ball by providing the board number location. Every bowling lane is manufactured with thirty-nine wood boards each being approximately one inch in width. The bowling training apparatus 100 is superposed the lane capping 99 and detects/provides the board number location as a bowling ball passes the bowling training apparatus 100. While the housing 10 could be manufactured in alternate widths, for ease of calibration purposes it is desired that the housing 10 be manufactured at a width equal to that of the lane capping 99 or a top portion thereof so as to ensure accuracy of the board number location provided.

The housing 10 has disposed therein a central processing unit 15. The central processing unit 15 is a conventional central processing unit and includes the necessary electronics to store, receive, transmit and manipulate data. Operably coupled to the central processing unit 15 is the display screen 20. The display screen 20 is integrally formed into the housing 10 and is operable to display the board number location as well as other data parameters that will be discussed further herein. The display screen 20 is a conventional LED screen but it is contemplated that alternate types of conventional display screens could be utilized. It is further contemplated within the scope of the present invention that the display screen 20 could be provided in alternate sizes. A power supply 25 is disposed within the interior volume of the housing 10. The power supply 25 is a conventional power supply such as but not limited to a rechargeable battery and is electrically coupled to the central processing unit 15 and is operable to provide the necessary power to operate the bowling training apparatus 100. Those skilled in the art should recognize that the power supply 25 could be alternate types of batteries or operate on AC voltage.

Figure 3:
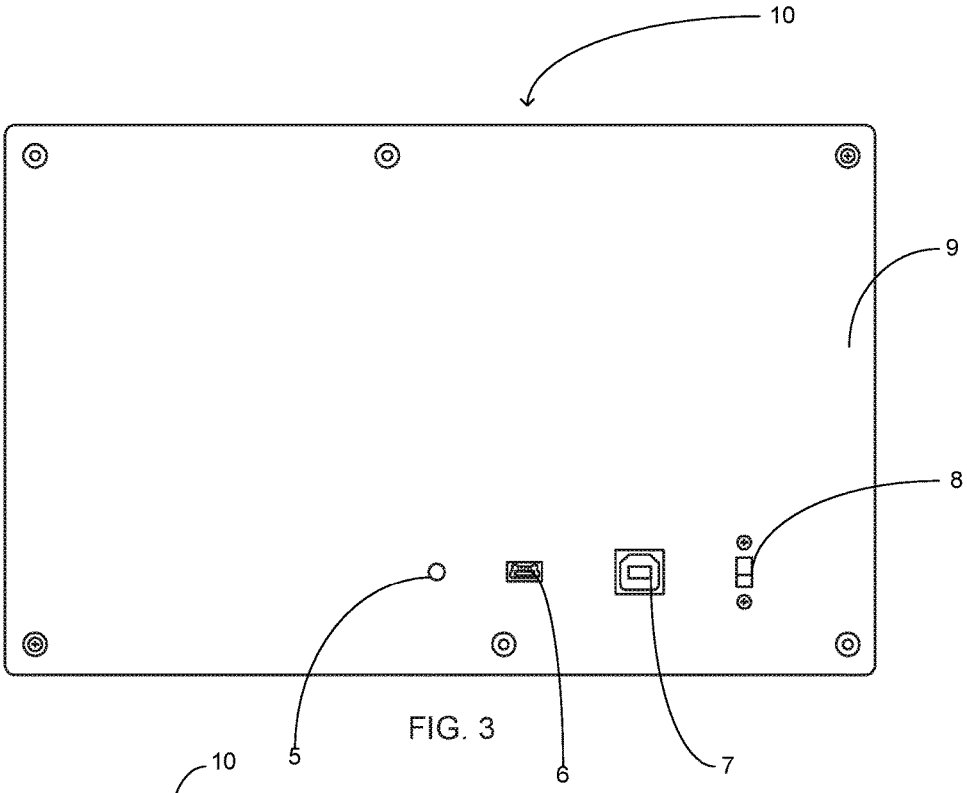
FIG. 3 is a rear view of the embodiment of the present invention.

Illustrated in FIG. 3 on the rear wall 9 of the housing 10 are a plurality of operational elements. A power switch 8 that is configured to power the bowling training apparatus 100 on and off. A service connection 7 which is a data transmission connector that is operable to facilitate connection of the bowling training apparatus 100 to a computer or other device as needed for service of the bowling training apparatus 100. A charging port 6 is provided and is electrically coupled to the power supply 15 and functions to provide charging and/or recharging thereof. It is further contemplated within the scope of the present invention that the charging port 6 could be configured to receive AC or DC power. An indicator light 5 is also present on the rear wall 9. The indicator light 5 is electrically coupled to the power supply 15 and functions to provide a visual indication of the status thereof.

Figure 6:
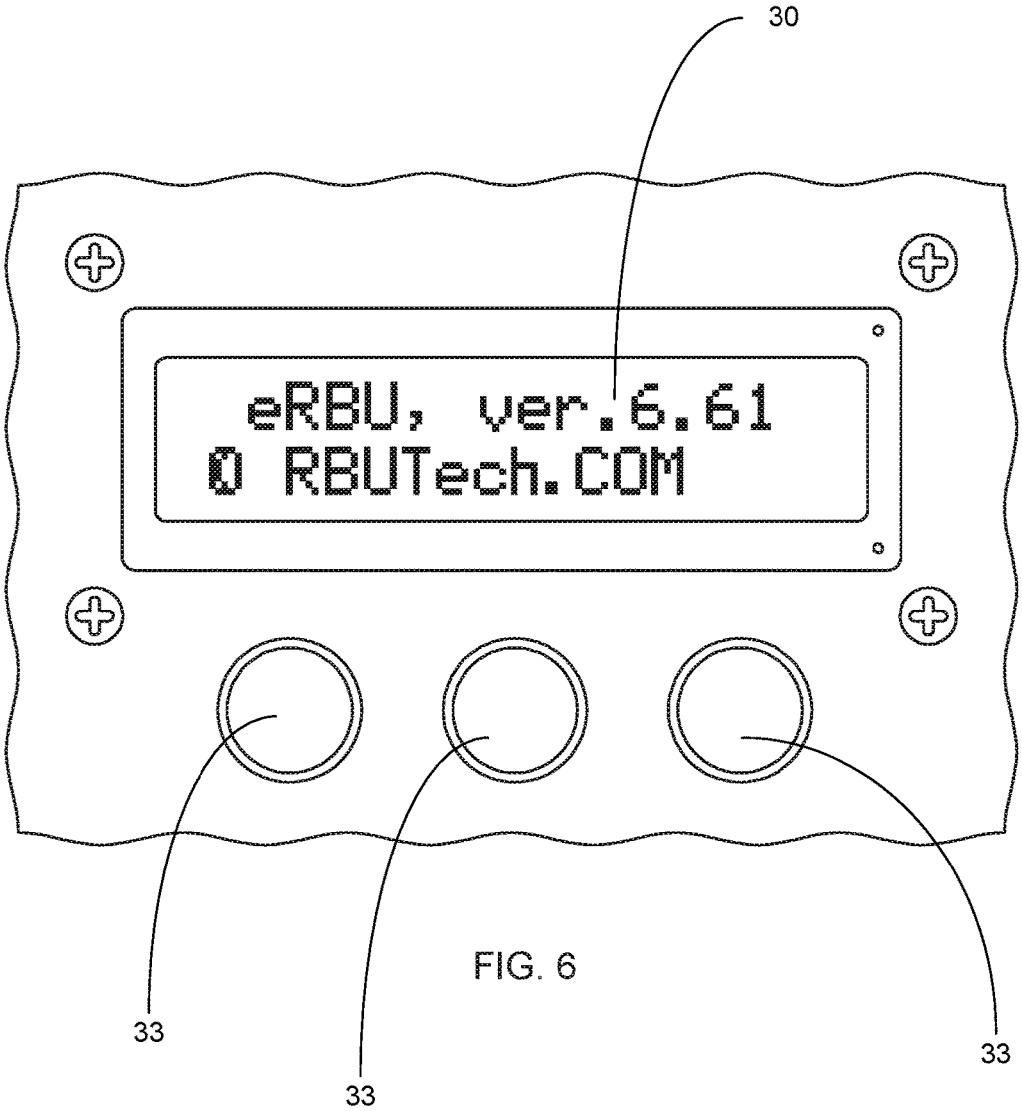
FIG. 6 is a detailed view of the interface screen and controls of the present invention.

Referring now to FIG. 6, a detailed view of the interface screen 30 and controls 33 are illustrated therein. The controls 33 are conventional push button type controls and are utilized to navigate through an operational menu that is displayed on the interface screen 33. It should be understood by those skilled in the art that the controls 33 and interface screen 30 are provided to facilitate the operation of the bowling training apparatus 100 by executing tasks such as but not limited to calibration of the bowling training apparatus 100 and data parameter selection to be displayed on display screen 20.

Illustrated herein in FIG. 4 is the sensor assembly 50 of the bowling training apparatus 100. The sensor assembly 50 is configured to measure various data parameters and transmit data signals to the central processing unit 15 so as to be displayed to a user via the display screen 20. The sensor assembly 50 is movably secured to the housing 10 utilizing mount 55. Mount 55 functions to releasably secure the sensor assembly 50 in the required position and provides the functionality to vertically adjust the sensor assembly 50 relative to the housing 10. The sensor assembly 50 must be positioned on the housing 10 where ball position sensor 60 is at a height that is equal to the midpoint of a bowling ball when the bowling ball is located adjacent to the ball position sensor 60. This facilitates the proper identification of the board number location as a bowling ball traverses past the ball position sensor 60.

The central processing unit 15 is programmed with the diameter and/or the circumference of a conventional bowling ball. The diameter and/or circumferential measurement of the bowling ball is utilized to calculate what board number (1-39) of a bowling lane 98 the bowling ball is located as it traverses past the sensor assembly 50. The ball position sensor 60 detects a bowling ball traversing therepast and its detection of the bowling ball occurs at the midpoint of the bowling ball when the sensor assembly 50 is placed in the desired position. The ball position sensor 60 captures the distance between the bowling ball traversing therepast and utilizing the aforementioned measurements the central processing unit 15 calculates the board number position that the bowling ball was located on as the bowling ball traversed past the sensor assembly 50. This board number location is then instantly displayed to the user via the display screen 20. The facilitation of the vertical adjustment of the sensor assembly 50 provided by mount 55 is critical so as to accommodate alternate heights that may occur across various exemplary lane cappings 99. It is contemplated within the scope of the present invention that the mount 55 could be constructed in numerous alternate manners so as to achieve the desired functionality as described herein.

The ball position sensor 60 is a conventional distance sensor such as but not limited to an ultrasonic sensor. While the ball position sensor in its preferred embodiment is a distance sensor, it is contemplated within the scope of the present invention that the ball position sensor 60 could be manufactured utilizing alternate sensors such as but not limited to an infrared sensor. A primary advantage of the bowling training apparatus 100 is the instant board position location provided to the user. It should be understood that board position number on is the board of the exemplary bowling lane 98 that is closest to the bowling training apparatus 100 and board position 39 is the board that is most distal to the bowling training apparatus 100.

The sensor assembly 50 further includes a temperature sensor 64 and a relative humidity sensor 66. It is contemplated within the scope of the present invention that temperature sensor 64 and relative humidity sensor 66 could be manufactured as one sensor. The temperature sensor 64 and relative humidity sensor 66 are conventional temperature and relative humidity sensors and are operable to capture the environmental temperature and relative humidity present on the bowling lane 98. The central processing unit 15 receives the temperature and relative humidity data from the sensor assembly 50 and displays to the user via the display screen 20. It is contemplated within the scope of the present invention that the temperature and relative humidity data could be displayed to the user at the initial powering on of the bowling training apparatus 100 and be subsequently provided at alternate intervals. While one sensor assembly 50 is illustrated and discussed herein, it is contemplated within the scope of the present invention that the bowling training apparatus 100 could have a second sensor assembly mounted on the opposing side of the housing 10 so as to provide the functionality discussed herein for a second adjacent bowling lane 98. It is further contemplated within the scope of the present invention that the temperature sensor 64 and relative humidity sensor 66 could be mounted to the housing 10 in place of securing within the sensor assembly 50.

The bowling training apparatus 100 is further configured to detect and provide the speed of a bowling ball traversing past the bowling training apparatus 100. To detect the speed of the bowling ball a first speed sensor 70 and a second speed sensor 72 is provided. The first speed sensor 70 is remotely located with respect to the housing 10 and is electrically coupled to the sensor assembly 50 utilizing wire 75. Integrated into the sensor assembly 50 is a second speed sensor 72. The first speed sensor 70 is operable to detect the passing of a bowling ball and ensuing detection of the passing bowling ball by the second speed sensor 72, the central processing unit will calculate the speed of the ball utilizing the known distance between the first speed sensor 70 and second speed sensor 72 along with the amount of time required to traverse the distance therebetween. It is contemplated within the scope of the present invention that the first speed sensor 70 and second speed sensor 72 could utilize various detection techniques to detect a bowling ball traversing therepast such as but not limited to photo sensors.

A lane board target light 80 is further provided in housing 10. It is contemplated within the scope of the present invention that the lane board target light 80 could be mounted either externally on the housing 10 or secured therein. The lane board target light 80 is operable to allow a user to illuminate a specific board on the exemplary bowling lane 98 that the user desires to locate the bowling ball during a throw. The lane board target light 80 utilizes a narrow beam of light such as but not limited to a laser light and is rotatably mounted utilizing suitable durable techniques. During installation of the bowling training apparatus 100 in preparation for use thereof, a user may use the lane board target light 80 to illuminate a board that is the desired board location for a bowling ball during a throw. By way of example but not limitation, if a user desires to locate the bowling ball on board number eleven, the user will rotate the lane board target light 80 so as to project the light beam therefrom on board number eleven. During use of the bowling training apparatus 100 the bowling ball will traverse past the sensor assembly 50 and the bowling training apparatus 100 will instantly provide feedback as to whether or not the bowling ball was located on board number eleven. It is contemplated within the scope of the present invention that the bowling training apparatus 100 could be provided either with or without the lane board target light 80.

Mounted to the housing 10 so as to be visible to a user of the bowling training apparatus 100 is speed indication light 97. The speed indication light 97 is configured to provide identification to a user that the value displayed on the display screen 20 is that of the speed of the bowling ball. The speed indication light 97 is a conventional LED light and it is operable to indicate to a user that the numeric value being displayed during illumination thereof is that of the speed of the bowling ball. It is further contemplated within the scope of the present invention that the bowling training apparatus 100 could be configured to alternately display the board number location and speed.

Housing 10 is configured to be temporarily secured to lane capping 99. Mounts 77 are utilized to provide temporary installation of housing 10 and are further configured to substantially inhibit vibrations from transferring to the housing 10. Mounts 77 are manufactured from rubber or a similar material and have a conical lower portion 78 that are operable to provide adhesion to the lane capping 99 when releasably secured thereto. It is contemplated within the scope of the present invention that the mounts 77 could be present in various quantities and further be provided in alternate configurations in order to accomplish the desired objective of providing temporary securing of the housing 10 and reduction of vibration. Mounts 77 are utilized to releasably secure and provide vibration reduction for housing 10 and first speed sensor 70.

Figure 5:
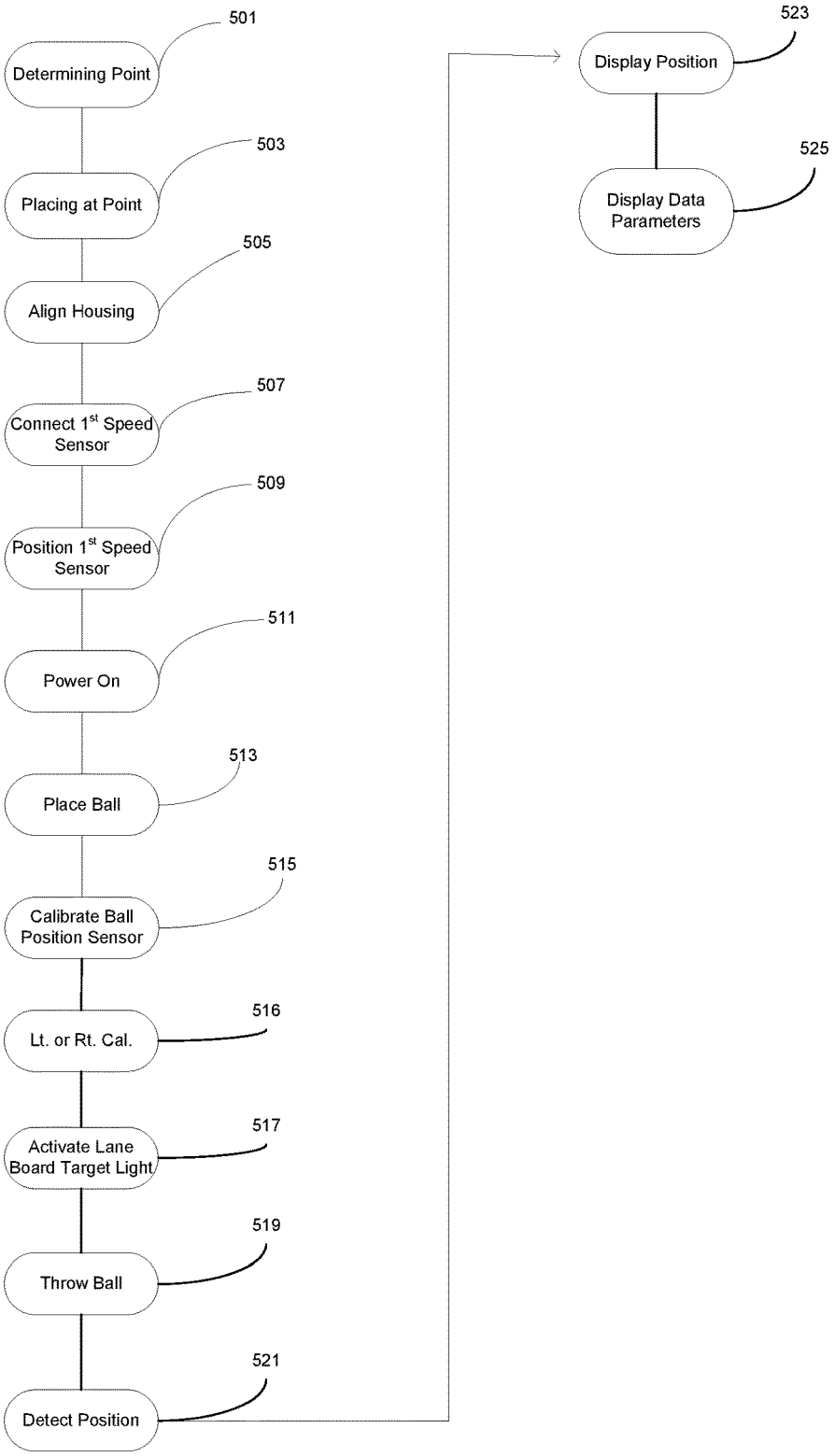
FIG. 5 is a flowchart of the method of use of the present invention.

Referring now to FIG. 5 herein, a method of use of the bowling training apparatus 100 is outlined therein. In step 501, a user will determine at what point on a bowling lane 98 they wish to identify the board number location of a thrown bowling ball. As discussed herein, the user may decide to select a target point, a break point or any other location on the bowling lane 98. Step 503, ensuing determination of a desired point, the user will place the bowling training apparatus 100 at the desired point, specifically on the lane capping 99 adjacent thereto. In step 505, the user will align the housing 10 with the lane capping 99 such that the housing is square in orientation therewith and that the edges of the housing 10 are axially aligned with the edges of the lane capping 99. Step 507, if desired, the user will operably couple the first speed sensor 70 to the sensor assembly 50 using wire 75. In step 509, the user will position the first speed sensor 70 on the lane capping 99 distal to the housing 10 towards the user throwing a bowling ball 10. Step 511, the user will power on the bowling training apparatus 100 using switch 8. In step 513, the user will place a bowling ball adjacent to the sensor assembly 50. Step 515, the user will vertically position the sensor assembly 50 such that ball position sensor 60 is located at the midpoint of the bowling ball. It should be noted that step 513 and step 515 need only be executed upon first use of the bowling training apparatus 100. It should be understood that the steps 513 and 515 need only be executed once during initial set up of the bowling training apparatus 100 and re-executed only as needed or desired by a user. In step 516, a user can adjust parameters so as to accommodate board strip location for either a left-handed or right-handed bowler. It is further contemplated within the scope of the present invention that this can be accomplished automatically wherein the bowling training apparatus 100 will provide indication of board location for right handed and left handed bowlers. Step 517, if desired, the user will activate the lane board target light 80 and illuminate the desired board number to which the user desires to throw the bowling ball. In step 519, the user will execute a throw of a bowling ball down the bowling lane 98. Step 521, as the bowling ball traverses past the sensor assembly 50, the ball position sensor 60 will detect the bowling ball and transmit the data signal to the central processing unit 15. In step 523, the central processing unit 15 will calculate the board number position and instantly display the board number on the display screen 20. Step 525, the bowling training apparatus 100 will display other desired data parameters such as but not limited to the temperature, relative humidity and ball speed. The display of other desired parameters can occur on all or a portion of the display screen 20.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bowling training apparatus operable to provide instant identification of a position of a bowling ball on a bowling lane comprising:

a housing, said housing including a plurality of walls integrally formed creating an interior volume, said housing being configured to be superposed on a lane capping intermediate adjacent bowling lanes, said housing further including a plurality of mounts, said mounts operable to releasably secure said housing and further inhibit vibration transfer;

a central processing unit, said central processing unit being disposed within the interior volume of said housing, said central processing unit having the necessary electronics to receive, store, transmit and manipulate data;

at least one sensor assembly, said at least one sensor assembly being secured to said housing, said at least one sensor assembly secured to said housing such that said at least one sensor assembly is proximate a bowling lane, said at least one sensor assembly including a ball position sensor, said ball position sensor configured to detect a bowling ball traversing past the bowling training apparatus;

a mount, said mount configured to movably secure said at least one sensor assembly to said housing, said mount facilitating the vertical movement of the at least one sensor assembly with respect to the housing; and wherein the bowling training apparatus is operable to instantly provide a board number location of a bowling ball traversing therepast and display the board number location on a display screen.

2. The bowling training apparatus as recited in claim 1, wherein the housing is manufactured to a width that is approximately equal to the width of the lane capping.

3. The bowling training apparatus as recited in claim 2, and further including a temperature sensor, said temperature sensor operable to detect environmental temperature of the area in which the bowling training apparatus is disposed.

4. The bowling training apparatus as recited in claim 3, and further including a speed sensor, said speed sensor operable to detect speed of a bowling ball traversing past the bowling training apparatus.

5. The bowling training apparatus as recited in claim 4, wherein the housing is configured to be movable along the lane capping so as to place the bowling training apparatus at various locations along the lane capping.

6. The bowling training apparatus as recited in claim 5, and further including a relative humidity sensor, said relative humidity sensor configured to detect and provide environmental relative humidity in which the bowling training apparatus is disposed.

7. The bowling training apparatus as recited in claim 6, and further including a lane board target light, said lane board target light mounted to said housing, said lane board target light operable to project a narrow beam of light to a specific board of a bowling lane.

8. A bowling training apparatus operable to provide a board number location for a bowling ball traversing therepast comprising:

a housing, said housing including a plurality of walls integrally formed creating an interior volume, said housing being configured to be movably superposed on a lane capping intermediate adjacent bowling lanes, said housing having an integrated display screen, said display screen positioned such that the display screen is visible to a user distally located on a bowling lane, said housing having a width that is approximately equal to the width of the lane capping, said housing further including a plurality of mounts, said mounts operable to releasably secure said housing and further inhibit vibration transfer;

a central processing unit, said central processing unit being disposed within the interior volume of said housing, said central processing unit having the necessary electronics to receive, store, transmit and manipulate data;

a sensor assembly, said sensor assembly being secured to said housing, said sensor assembly secured to said housing such that said sensor assembly is proximate a bowling lane, said sensor assembly including a ball position sensor, said ball position sensor configured to detect a bowling ball traversing past the bowling training apparatus, said sensor assembly further including a first speed sensor;

a mount, said mount operable to movable couple said sensor assembly to said housing, said mount configured to facilitate the vertical adjustment of the sensor assembly relative to the housing so as to position the ball position sensor such that the ball position sensor is at a height that is equal to that of the midpoint of an adjacent bowling ball; and wherein the bowling training apparatus is operable to instantly provide a board number location of a bowling ball traversing therepast and display the board number location on a display screen.

9. The bowling training apparatus as recited in claim 8, wherein the ball position sensor manufactured from a group of sensors selected from one of the following: ultrasonic sensor, photo sensor or infrared sensor.

10. The bowling training apparatus as recited in claim 9, and further including a second speed sensor, said second speed sensor being located on the lane capping distal to the housing, said second speed sensor being operably coupled to said first speed sensor.

11. The bowling training apparatus as recited in claim 10, wherein the housing is configured to be place at numerous alternate points along the lane capping.

12. The bowling training apparatus as recited in claim 11, and further including a lane board target light, said lane board target light rotatably mounted to said housing, said lane board target light configured to illuminate a narrow beam of light to a specific board of a bowling lane.

13. The bowling training apparatus as recited in claim 12, and further including a relative humidity sensor, said relative humidity sensor configured to detect and provide environmental relative humidity in which the bowling training apparatus is disposed.

14. The bowling training apparatus as recited in claim 13, wherein the housing is configured to be located along the lane capping adjacent to at least one of the following points of the bowling lane: a target point or a break point.

15. A bowling training method operable to provide a board number location for a bowling ball traversing therepast comprising the steps of:

providing a bowling training apparatus, wherein the bowling training apparatus includes a housing, said housing including a plurality of walls integrally formed creating an interior volume, said housing having opposing lateral edges, said housing having an integrated display screen, said display screen positioned such that the display screen is visible to a user distally located on a bowling lane, said housing having a width that is approximately equal to the width of the lane capping, wherein the housing further includes sensor assembly, said sensor assembly being secured to said housing, said sensor assembly secured to said housing such that said sensor assembly is proximate a bowling lane, said sensor assembly including a ball position sensor, said ball position sensor configured to detect a bowling ball traversing past the bowling training apparatus, said housing further including a plurality of mounts, said mounts operable to releasably secure said housing and further inhibit vibration transfer;

determining a location to position the housing, said housing being configured to be movably superposed the lane capping intermediate adjacent bowling lanes;

positioning the housing such that the housing is superposed the lane capping adjacent a bowling lane wherein the opposing lateral edges of the housing are axially aligned with border edges of the lane capping;

placing a bowling ball adjacent to the sensor assembly;

adjusting the sensor assembly, wherein the sensor assembly is vertically adjusted to position the ball position sensor such that the ball position sensor is at a height equal to a midpoint of the adjacent bowling ball;

throwing the bowling ball, wherein a user will throw the bowling ball down the bowling lane;

detecting a position of the bowling ball, wherein the ball position sensor detects the position of the bowling ball on the bowling lane when adjacent thereto;

transmitting a data signal, wherein the ball position sensor transmits a data signal to a central processing unit, said central processing unit being disposed within the interior volume of said housing, said central processing unit having the necessary electronics to receive, store, transmit and manipulate data;

displaying a ball position, wherein the central processing unit calculates a board number location and transmits the board number location to a display screen visible to a user.

16. The bowling training method as recited in claim 15, and further including the step of measuring the speed of the bowling ball, wherein the sensor assembly includes a first speed sensor that is operably coupled to a second speed sensor located distal to said housing wherein the first speed sensor and second speed sensor are electrically coupled.

17. The bowling training method as recited in claim 16, wherein the step of adjusting the sensor assembly includes utilization of a mount, said mount operable to movable couple said sensor assembly to said housing, said mount configured to facilitate the vertical adjustment of the sensor assembly relative to the housing so as to position the ball position sensor such that the ball position sensor is at a height that is equal to that of the midpoint of an adjacent bowling ball.

18. The bowling training method as recited in claim 17, wherein the bowling training apparatus further includes a temperature sensor and a relative humidity sensor.

19. The bowling training method as recited in claim 18, wherein the step of detecting a position of the bowling ball further includes calculating a board number on which the bowling ball was superposed as the bowling ball traversed past the sensor assembly wherein the board number calculation ranges from 1 to 39.

20. The bowling training method as recited in claim 19, and further including the step of activating a lane target board light, said lane board target light rotatably mounted to said housing, said lane board target light configured to illuminate a narrow beam of light to a specific board of a bowling lane.

* * * * *